US009265399B2

(12) United States Patent
Gram et al.

(10) Patent No.: US 9,265,399 B2
(45) Date of Patent: Feb. 23, 2016

(54) DISHWASHER WITH A DYNAMIC FILLING SEQUENCE

(75) Inventors: Markus Gram, Augsburg (DE); Peter Schweier, Forheim (DE)

(73) Assignee: BSH Hausgeraete GmbH, Munich (DE)

( * ) Notice: Subject to any disclaimer, the term of this patent is extended or adjusted under 35 U.S.C. 154(b) by 658 days.

(21) Appl. No.: 13/111,988

(22) Filed: May 20, 2011

(65) Prior Publication Data

US 2011/0297189 A1 Dec. 8, 2011

(30) Foreign Application Priority Data

Jun. 7, 2010 (DE) ..... 10 2010 029 730

(51) Int. Cl.
*A47L 15/42* (2006.01)
*A47L 15/00* (2006.01)

(52) U.S. Cl.
CPC ..... *A47L 15/0023* (2013.01); *A47L 2401/08* (2013.01); *A47L 2501/01* (2013.01)

(58) Field of Classification Search
CPC ..... A47L 15/0023; A47L 2401/08; A47L 2501/01
USPC ..... 134/25.2, 56 D, 57 D, 58 D
See application file for complete search history.

(56) References Cited

U.S. PATENT DOCUMENTS 2,975,902 A * 3/1961 Pinder ..... 68/12.06
5,284,523 A * 2/1994 Badami et al. ..... 134/18
6,887,318 B2 * 5/2005 Bashark ..... 134/18
2006/0219262 A1 * 10/2006 Peterson et al. ..... 134/18
2007/0151579 A1 * 7/2007 Hooker et al. ..... 134/18

FOREIGN PATENT DOCUMENTS

EP 1029498 A2 * 8/2000

OTHER PUBLICATIONS

Machine translation of EP1029498A2.*
Machine translation of EP1029498A2 dated Aug. 2000 (translation done 11/22/13).*

* cited by examiner

*Primary Examiner* — Douglas Lee
(74) *Attorney, Agent, or Firm* — James E. Howard; Andre Pallapies

(57) ABSTRACT

A dishwasher method and apparatus providing an algorithm varying the speed of the recirculation pump that recirculates washing liquor present in the washing compartment so as to assure quiet pump operation is disclosed. The speed of the recirculation pump is varied by a control device that carries out the washing cycle. A true-running monitoring unit checks the operation of the recirculation pump. During a fill phase of the washing cycle, an inlet valve is opened, the recirculation pump is switched on and the algorithm provides stepped variation of the recirculation speed using a default value step, a test step in which a true running check is performed, and a modification step in which the default value is modified in response to the result of the test step, for use in the next iteration of the algorithm.

17 Claims, 5 Drawing Sheets

DISHWASHER WITH A DYNAMIC FILLING SEQUENCE

BACKGROUND OF THE INVENTION

The present invention relates to a dishwasher, especially a household dishwasher, with a control device for carrying out a washing cycle for cleaning items to be washed, with a washing compartment for accommodating the items to be washed during the washing cycle, with an inlet valve able to be opened and closed by the control device for letting washing liquor into the washing compartment, with a recirculation pump for recirculating the washing liquor present in the washing compartment, the speed of which is able to be varied by the control device and with a true running monitoring unit for checking that the recirculation pump is running true.

Commercially available dishwashers are embodied to automatically fill their washing compartment with washing liquor. Despite a to some extent complex filling process, which as a rule carried out a number of times during a washing cycle, the throughflow quantity of washing liquor is not always dispensed exactly. In addition in a few filling processes undesired noise can be generated while the washing compartment is being filled with washing liquor.

BRIEF SUMMARY OF THE INVENTION

It is an object of the present invention to provide a dishwasher, especially a household dishwasher, in which the process of filling of the washing compartment with washing liquor is improved.

The object is achieved for a dishwasher of the type stated at the outset by the washing cycle comprising at least one filling sequence in which during a fill phase the inlet valve is opened and the recirculation pump is switched on with an algorithm for varying the speed of the recirculation pump being provided for the fill phase, with the algorithm comprising a variation step for graduated variation of the speed by a default value, a checking step for carrying out a true running check and a modification step for modifying the default value for carrying out the variation step again as a function of a result of the test step.

The inventive dishwasher has a control device for automatically executing operational sequences of the dishwasher. To this end the control device can be embodied as a so-called sequence control, especially as an electronic sequence control.

Stored in the control device is at least one washing program for executing or controlling a washing process, also referred to as a washing cycle, for washing items to be washed, especially for washing dishes. Advantageously in this case a number of washing programs are provided, of which one can be selected and started by the user in each case. This makes it possible to adapt the execution sequence of a washing cycle, especially to the load, to the load type, to the degree of soiling of the items to be washed and/or to the desired duration of the washing cycle etc. . . . .

The stored washing programs can preferably be embodied so that the washing cycle controlled by them especially includes at least one pre-wash cycle for cleaning items to be washed, especially one cleaning cycle for thorough cleaning of items to be washed, especially one intermediate washing cycle for removing soiled washing liquor from the items to be washed, at least one rinsing cycle for avoiding smears on the items to be washed and/or for preparing for a drying step, and/or at least one drying cycle for drying the items to be washed. Pre-wash cycle, cleaning cycle, intermediate wash cycle and rinse cycle are referred to as water-conducting part wash cycles, since the items to be washed inserted into the washing compartment are treated with a washing liquor during execution of these steps. During the drying cycle there is generally no provision for using washing liquor.

The treatment of the items to be washed with washing liquor is undertaken in this case in an essentially closed washing compartment, especially a washing container, of the dishwasher. In such cases an inlet valve is assigned to the washing compartment which makes it possible to let washing liquor into the washing compartment. In such cases the inlet valve is able to be opened and closed by the control device in order in this way to influence the inflow of washing liquor.

A washing liquor here is especially to be understood as a liquid which is intended to be applied to the items to be washed, in order to clean said items and/or treat them in another way. Thus the washing liquor can be provided for example for heating up the items to be washed which is usual for example during a rinsing step.

The washing liquor entering the washing compartment via the inlet valve is generally fresh water. In such cases the washing liquor in the washing compartment, depending on the operating phase of the dishwasher, can have cleaning agents, cleaning aids such as for example rinsing agents and/or soiling which is removed from the items to be washed, contained in it. However there are also cases conceivable in which the washing compartment is filled via the inlet valve with water which already has additives as the washing liquor.

Furthermore the washing compartment is assigned a recirculation pump for recirculating the washing liquor with which the washing compartment is filled which makes it possible to take the washing liquor present in the washing compartment from a collection device for washing liquor for example and to apply it to the items to be washed via a spray system assigned to the washing compartment. The speed of the recirculation pump in such cases is able to be controlled and/or regulated in a variable manner by the control device.

The dishwasher further includes a true running monitoring unit for checking the true running of the recirculation pump. The true running monitoring unit can especially be a component of the control device or be connected to the control device of the dishwasher for exchange of data.

In such cases a recirculation pump is generally running true if there is sufficient washing liquor in the collection device of the washing compartment to prevent air being sucked in by the recirculation pump. Whether air is now sucked in or not in the individual case depends in such cases on factors such as the speed of the recirculation pump. The reason for this lies in the fact that, as the speed of the recirculation pump increases, an ever smaller part of the overall washing liquor present in the washing compartment is located in the collection device, since it takes a certain time for the washing liquor sprayed onto the items to be washed to arrive back at the collection device. The speed at which true running is just still possible is referred to as the maximum true running speed.

The inventive dishwasher is embodied so that, during the execution of a washing cycle, at least one fill sequence to fill the washing compartment with washing liquor is carried out, which comprises a fill phase during which the inlet valve is open and the recirculation pump is switched on. In this way it is ensured that the washing liquor is already applied to the items to be washed during the filling of the washing compartment with washing liquor, so that the cleaning effect starts at an early stage, whereby the duration of the washing cycle can be shortened with the same cleaning results compared to such washing cycles in which the washing compartment is filled with the recirculation pump at a standstill. Such a fill sequence can be provided for example at the beginning of one of the water-conducting part wash cycles of the washing cycle, at the beginning of a number of the water conducting part wash cycles of the wash cycle or respectively at the beginning of all of the water conducting part wash cycles of the washing cycle.

In this case an algorithm, i.e. an execution sequence procedure or series of execution sequence steps to vary the speed of the recirculation pump is provided for the fill phase, which allows or allow the speed of the recirculation pump to be adapted to the quantity of washing liquor increasing during the course of the fill phase such that on the one hand the recirculation pump is always operated at a relatively high speed and on the other hand the recirculation pump is operated in a true running mode for a significant part of the duration of the fill phase. In this way during the fill phase the cleaning effect is increased by the washing liquor being applied to the items to be washed in an optimized manner and at the same time the noise level of the dishwasher is reduced since disruptive slurping noises as the recirculation pump sucks in air can be largely avoided. The algorithm or the sequence of execution steps can be controlled in such cases by the control device of the dishwasher.

The algorithm for varying the speed comprises a variation step for graduated variation of the speed by a default value. This means that the variation step is used for the actual adaptation of the speed of the recirculation pump stop For example the default value can involve a summand, so that the speed provided after the variation step is produced from the sum of the speed provided before the variation step and the default value. The variation step can for example be executed by the control device of the dishwasher.

Furthermore the algorithm includes at least one test step for carrying out a true running test. It can be established by means of the respective test step whether the recirculation pump is running true at the speed produced by the previously executed variation step or not. The respective test step can especially be executed by the true running monitoring unit.

The results can then be included in a subsequent variation step for varying the default value in order to adapt the default value so that. In a further variation step with the new default value, an optimum adaptation of the speed of the recirculation pump to the current amount of washing liquor can be carried out. To this end the result of the test step can be transferred from the true running monitoring unit to the control device, which can then carry out a variation step.

This sequence of steps which comprises a variation step, a test step and a modification step can be repeated until such time as a sufficient quantity of washing liquor has been let into the washing compartment. In this way it is possible to operate the recirculation pump at a high speed during the entire fill phase without there being the danger of the recirculation pump permanently being operated outside its true running mode.

In this case only a small data processing overhead is necessary for executing the algorithm. It is thus sufficient in almost all cases for the sequence of steps to be carried out with a repeat frequency of around 0.1 to 10 Hz. Carrying out the fill sequence thus does not make any particular demands on the speed of the control device or on other dishwasher components involved. A significant advantage of the inventive dishwasher thus lies in its simplicity.

In accordance with an expedient development of the invention the algorithm includes an abort step to terminate the fill sequence on reaching an end value provided for the speed and for the recirculation pump which is preferably in free running mode. The end value can correspond to that speed with which the recirculation pump is operated after the fill sequence. In this way it can be ensured that at the end of the fill sequence an optimized amount of washing liquor is present in the washing compartment. On the one hand this enables a malfunction of the dishwasher because of too small an amount of washing liquor to be avoided and on the other hand allows an unnecessarily high consumption of washing liquor to be avoided.

Deviations in the inflow, i.e. the inflowing amount of washing liquor per unit of time from a nominal inflow, are automatically compensated for by the algorithm. The fill phase, unlike with a pure timed control of the inlet valve, is continued until such time as an optimized amount of washing liquor is present in the washing compartment. In such cases measuring the inflow or the amount of washing liquor in the compartment, with an impeller meter for example, is not necessary. A simple, switchable inlet valve can especially be used in such cases, which can assume just an open position and a closed position, since control or regulation of the inflow of washing liquor during filling of the washing compartment is not necessary. This also enables the control device to be embodied in a simple manner since it is merely provided to output two control commands to the inlet valve, namely "open valve" and "close valve".

Furthermore the algorithm excludes the possibility of a fill level that is too low being produced in the washing compartment, as a result of a significant part of the supplied washing liquor having collected in an incorrectly inserted hollow vessel, for example in a pot with an opening pointing upwards. Measuring the fill level with a special fill level sensor is not required to detect this condition. The inventive dishwasher can consequently be of a very simple design.

In addition it is not necessary with the algorithm to temporarily close the inlet valve during the inflow sequence. In this way the fill sequence can be concluded significantly more quickly than with fill methods which basically provide for a multi-stage filling.

In accordance with an advantageous embodiment of the invention the default value is greater than or equal to zero if the result of the test step is that the recirculation pump is running true. In this way the speed can be prevented from being reduced unnecessarily.

In accordance with an advantageous development of the invention there is provision for the default value to be increased if the results of consecutive test steps consist of the recirculation pump running true in each case. In this way the actual speed can be made to more quickly approach that speed at which true running is still just possible.

In accordance with an advantageous development of the invention the increase in the default value is suppressed if a maximum value provided for the default value is reached. This avoids increasing the default value without restriction, which could lead to the speed at which true running is still possible being disproportionately exceeded during continued execution of the algorithm, which could lead to an oscillation of the algorithm. An oscillation of the algorithm in this case is especially to be understood as a process in which larger variations of the speed around the optimum value occur.

In accordance with an expedient development of the invention the default value is less than or equal to zero if the result of the test step is that the recirculation pump is not running true. The effect of the recirculation pump not running true here is that the speed is reduced and in this way, after one or more variation steps, true running of the recirculation pump is achieved.

In accordance with an advantageous development of the invention, if the results of consecutive test steps consist of the recirculation pump not running true, there is provision for the default value to be lowered. In this way true running can be achieved more quickly.

In accordance with an advantageous development of the invention the lowering of the default value is suppressed if a minimum value provided for the default value is achieved. A disproportionate lowering of the default value can be avoided by this, which could lead to the speed at which true running is still possible being disproportionately undershot if the algorithm continues to be executed, which could then lead to an oscillation of the algorithm.

In accordance with an advantageous development of the invention, if the results of consecutive test steps consist of the recirculation pump running true in one of the test steps and not running true in the next test step, or of the recirculation pump not running true in one of the test steps and running true in the next test step, there is provision for the default value to be set to zero. In this way, if there is a change from true running to non-true running or from non-true running to true running a provisional approximation to that speed is bought about at which true running is still possible with the amount of washing liquor present in each case. In particular an exaggerated change in the default value and subsequently the speed can be avoided in this way, which could lead to an oscillation of the algorithm.

In accordance with an advantageous embodiment of the invention, during a pre-fill phase carried out before the fill phase the inlet valve is opened and the recirculation pump is switched off, whereby the duration of the pre-fill phase depends on a default time value. In this way slurping noises can be prevented from occurring in an early phase of the fill sequence in which the level of washing liquor in the washing compartment is still low. Pure time control of the inlet valve can be easily implemented. Just one timing element is sufficient, which is integrated into the control device and can be embodied as a software module. Additional sensors or further components are generally not required. The relative imprecision of the amount of washing liquor supplied during the pre-fill phase can be automatically compensated for by the subsequent fill phase, so that at the end of the fill sequence there is still an optimized amount of washing liquor present in the washing compartment.

In accordance with an advantageous development of the invention, at the beginning of the fill phase a start value is provided for the speed such that, for an inflow of washing liquor lying within a normal range, the recirculation pump is running true in the first test step. Usually a normal range for the inflow is defined for a dishwasher. For example an upper limit can be provided for the normal range which exceeds the nominal inflow by a specific percentage value, for example 10%. Likewise a lower limit can be provided for the normal range which undershoots the nominal inflow by a specific percentage value, for example 10%. If the start value for the speed is now defined so that, for an inflow lying within the normal range, the recirculation pump is running true in the first test step, it is thus ensured in cases which are of relevance in practice that the speed approaches the optimum value from below. Slurping noises can be avoided by this, at least in the initial phase.

In accordance with an advantageous development of the invention the default value corresponds to its intended maximum value at the beginning of the fill phase. In this way the approximation to the optimum value can be accelerated, which is of advantage especially with a relatively large inflow.

In accordance with an advantageous development of the invention the inlet valve is opened during a post-fill phase carried out after the fill phase and the recirculation pump is switched on, whereby the duration of the post-fill phase depends on a default time value. In this way a defined surplus of washing liquor can be supplied to the washing compartment to ensure even in unfavorable conditions, for example for a hollow vessel which turns or tips after the fill sequence and becomes full of washing liquor, which thus removes washing liquor from the recirculation circuit, that the recirculation pump is running true.

In accordance with an advantageous development of the invention the recirculation pump includes an electric motor, with the true running monitoring unit being embodied for supervising fluctuations of at least one electrical operating parameter of the electric motor. If the amount of washing liquor in the washing compartment is too small, the recirculation pump, as already described, not only sucks in washing liquor but also air. The ratio of sucked-in air and sucked-in washing liquor fluctuates in such cases around a statistical mean value. These fluctuations in their turn lead to fluctuations of the electrical operating parameter of the recirculation pump, so that the evaluation of the fluctuations without recording the absolute value of the operating parameter allow information to be provided as to whether the recirculation pump is running true or not. This enables the quality of the true running checks to be improved. The true running monitoring unit can be embodied in such cases for recording the electrical power of the recirculation pump. For example the true running monitoring unit can be embodied for this purpose for recording the electrical power consumption. By analyzing the recorded power it can be established by the true running monitoring unit whether the recirculation pump is running true or not. In such cases, especially when the actual power deviates from an intended power and/or with large fluctuations of the power over the course of time, it can be concluded that the recirculation pump is not running true.

The recirculation pump can have a brushless electric motor, for example a brushless DC motor. The brushless electric motor can especially be embodied as a permanent magnet motor. Such a brushless permanent magnet motor can be embodied as a brushless DC motor, also referred to as a BLDC motor, as a brushless AC motor, also referred to as a BLAC motor, or as a synchronous motor. The rotor of the motor in such cases includes a least one permanent magnet, while the stator features a number of electromagnets. The electromagnets in such cases are commutated via control electronics. By comparison with other possible motor concepts, this enables both the direction of rotation and also the speed of the motor to be controlled in a simple manner. By operating the motor in precisely one direction of rotation it is possible to optimize the water-conducting parts of the recirculation pump as regards flow technology. This results in a high pump power with low energy usage. In addition the pump power of the recirculation pump can be controlled in accordance with demand, which further increases the energy efficiency. Furthermore the brushless permanent magnet motor can be embodied as a submersible motor so that expensive sealing measures are dispensed with.

The invention further relates to a method for operating a dishwasher, especially in accordance with one of the claims, with a control device for carrying out a washing cycle for cleaning items to be washed, with a washing compartment for accommodating items to be washed during the washing cycle, with an inlet valve able to be opened and closed by the control device for filling the washing compartment with washing liquor, with a recirculation pump for recirculating the washing liquor to be found in the washing compartment, the speed of which is able to be varied by a control device, and with a true running monitoring unit for carrying out a true running check on the recirculation pump. In this method at least one fill sequence is carried out during the washing cycle, in which during a fill phase the inlet valve is opened and the recirculation pump is switched on, whereby during the fill sequence an algorithm for varying the speed of the recirculation pump is executed, whereby in the execution of the algorithm a variation step for graduated variation of the speed by a default value, a test step for carrying out a true running check and a modification step for modifying the default value for a renewed execution of the variation step are carried out as a function of a result of the test step.

The inventive method makes possible a simple, fast and secure execution of a washing cycle and is characterized by its low demands on the mechanical design of the dishwasher.

Other advantageous embodiments and/or developments of the invention are to be found in the claims.

The advantageous developments of the invention specified in the dependent claims and/or explained here can be provided individually or in any given combination with one another.

BRIEF DESCRIPTION OF THE DRAWINGS

The invention, its features and advantages, will be better understood when the detailed description of a presently preferred embodiment provided below is considered in conjunction with the Figures, wherein.

Figure 1:
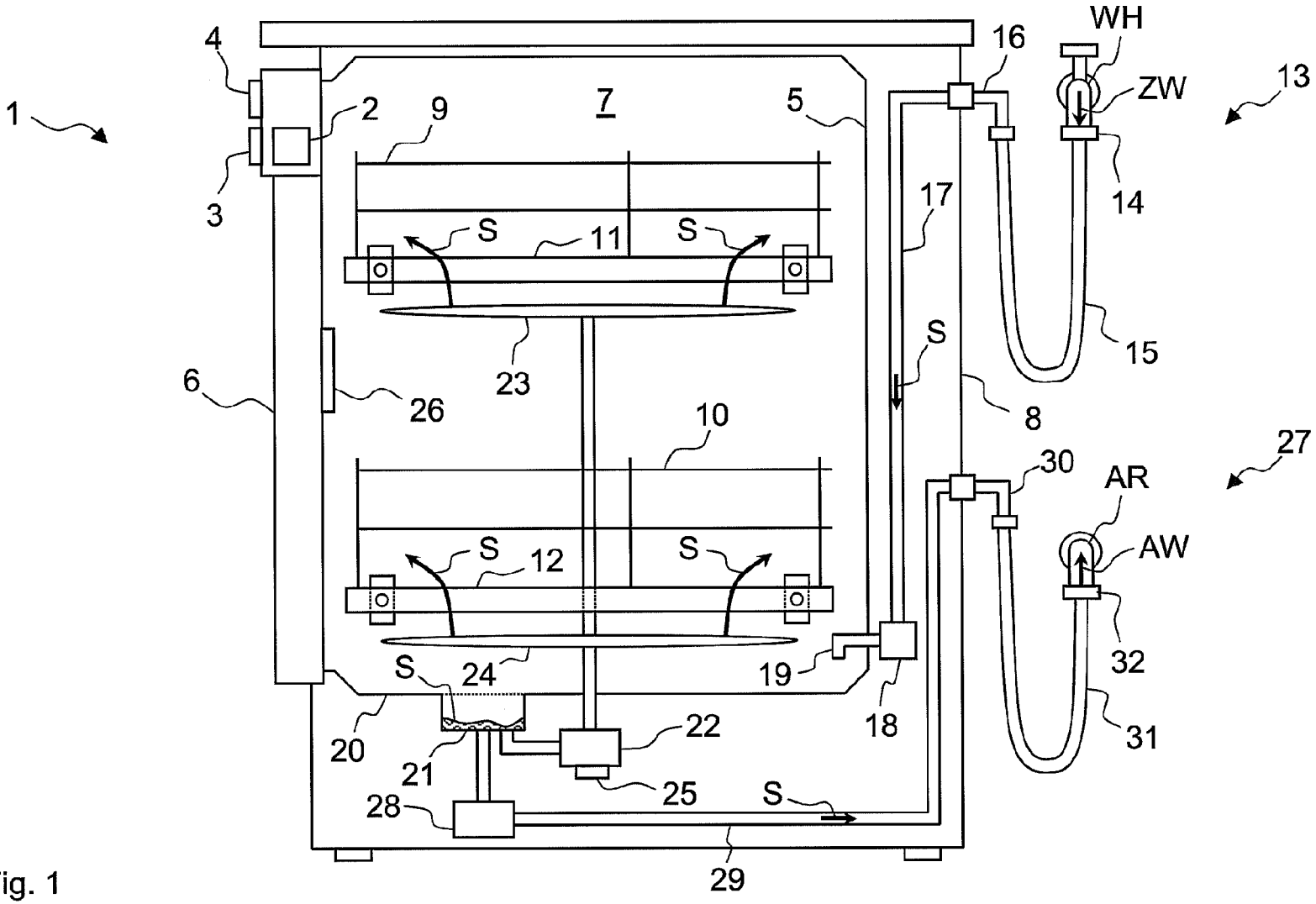
FIG. 1 is a schematic side view of a presently preferred embodiment of a household dishwasher constructed in accordance with the present invention.

Parts that correspond to one another are provided with the same reference characters in the figures below. In such cases only those components of the dishwasher as are necessary for understanding the invention are provided with reference characters and explained. It goes without saying that the inventive dishwasher can comprise further parts and modules.

DETAILED DESCRIPTION OF A PREFERRED EMBODIMENT OF THE PRESENT INVENTION

FIG. 1 shows an advantageous exemplary embodiment of an inventive household dishwasher 1 in a schematic side view. The dishwasher 1 comprises a control device 2 in which at least one washing program for controlling a washing cycle for washing items to be washed, especially dishes, is stored. Expediently a number of washing programs are stored in this case so that, by selecting a suitable washing program, the execution sequence of a washing cycle controlled by the control device 2 can be adapted to the load, to the degree of soiling of the items to be washed and/or to a desired duration of the washing cycle, for example.

The control device 2 is assigned an operating device 3 which allows a user of the dishwasher 1 to call up one of the washing programs and start it through the device. The control device 2 is further assigned an output device 4 which makes it possible to output messages to the user. The output device 4 can have indicator lamps, light emitting diodes, an alphanumeric display and/or a graphical display for output of optical or visual messages. In addition or independently, the output device 4 can have a buzzer, a loudspeaker and/or the like for output of acoustic messages.

The dishwasher 1 further comprises a washing container 5 able to be closed off by a door 6, so that a closed washing compartment 7 for washing items to be washed is produced. The washing container 5 can be arranged in such cases if necessary inside a housing 8 of the dishwasher 1. The housing 8 is not necessary with built-in dishwashers and can sometimes be omitted completely. The door 6 is shown in its closed position in FIG. 1. The door 6 is able to be moved into an open position by pivoting it around an axis arranged vertically to the plane of the drawing, in which position it is aligned substantially horizontally and makes it possible to insert or remove items to be washed. In the exemplary embodiment shown in FIG. 1 the operating device 3 is arranged in a user-friendly manner in an upper section of the door 6. The output device 4 is likewise arranged in an upper section of the door 6 so that optical or visual messages are easily visible and/or acoustic messages are easily audible. The control device 2 is also positioned there so that the necessary signal connections between the operating device 3, the output device 4 and the control device 2 can be kept short. In principle it is possible however to arrange the operating device 3, the output device 4 and/or the control device 2 at another position. In particular the control device can, in accordance with an alternate embodiment variant, be accommodated if necessary in a floor module below the washing container. The control device 2 can also be embodied as a decentralized device, which means that it comprises spatially-distributed components which are connected via communication means such that they can interoperate.

The dishwasher 1 has an upper crockery basket 9 and a lower crockery basket 10 for positioning crockery. The upper crockery basket 9 is arranged in this case on telescopic rails 11 or other telescopic means which are each attached to opposite sidewalls of the washing container 5 extending in the depth direction of the washing container. The crockery basket 9 is able to be moved out of the washing container 5 by means of the telescopic rails 11 when the door 6 is open, which facilitates loading or unloading of the upper crockery basket 9. The lower crockery basket 10 is arranged in a similar manner on telescopic rails.

The washing program or programs stored in the control device 2 can each provide a number of part washing cycles, for example in this sequence at least one pre-wash cycle, at least one cleaning cycle, at least one intermediate wash cycle, at least one rinsing cycle and/or at least one drying cycle. In this case pre-wash cycle, cleaning cycle, intermediate wash cycle and rinse cycle are referred to as water-conducting part wash cycles, since during their execution the items to be washed positioned in the washing compartment 7 are treated with a washing liquor S. During the drying cycle there is generally no provision for treatment of the items to be washed with washing liquor S.

Fresh water or inlet water ZW can be used as washing liquor S for treating the items to be washed in the exemplary embodiment, which can be taken from an external water supply device WH, especially a drinking water supply network, and let into the washing compartment 7. Typically in such cases at the beginning of each water conducting part wash cycle a washing liquor S formed from fresh inlet water ZW is supplied, which is then drained off as waste water AW at the end of the respective part wash cycle to an external waste water disposal device AR. It is however also possible to store a washing liquor S of a part wash cycle in a storage container not shown in the figure and to supply it to the washing compartment 7 again in a later part wash cycle.

The dishwasher 1 of FIG. 1 in this case comprises a water inlet device 13 which is intended to be connected to an external water supply device. As in FIG. 1, the external water supply device includes a water faucet WH of a building-side water installation which provides inlet water ZW under pressure. The water inlet device 13 includes a connecting piece 14 which is intended to be connected to the water faucet WH. The connection can typically be made via a screw arrangement, a bayonet arrangement or the like. Downstream from the connecting piece 14 a connecting hose 15 is provided which is preferably embodied as a flexible hose. The downstream end of the connecting hose 15 is provided with a connecting piece 16 fixed to the housing.

A supply line 17 is provided downstream from the connection piece 16 fixed to the housing which is connected to an input side of an inlet valve 18 able to be switched by means of the control device 2. An output side of the inlet valve 18 in its turn is connected to a fluid inlet 19 of the washing compartment 7. In this way it is possible by means of the water inlet device 13 to direct inlet water ZW as a washing liquor S into the inside of the washing compartment 7 of the dishwasher 1. The inlet valve 18 can be embodied as a switchable magnetic valve in this case which has only an open position and a closed position. In the supply line 17 a water processing system, for example a softening system, not shown in the diagram can be provided.

Instead of or in addition to the device-side inlet valve 18, an external inlet valve can also be provided between the connecting piece 14 and the water faucet WH, especially a so-called Aquastop valve, which is preferably able to be switched by means of the control device, especially able to be blocked or opened.

The amount of washing liquor S supplied to the washing compartment 7 per unit of time, i.e. the inflow, is in this case especially primarily a result of the construction of the inflow valve 18 and the pressure of the washing liquor S on the entry side of the inlet valve 18. Under normal conditions a constant nominal inflow is produced with the inlet valve 18 open. As a result of deviations in series production in the manufacturing of the inlet valve 18 or as a result of other circumstances, the actual inflow can lie above or below the nominal inflow. Usually a standard range for the inflow is defined for a dishwasher for which the function of the dishwasher is guaranteed. For example an upper limit can be provided for the standard range, which exceeds the nominal inflow by a specific percentage value, for example 10%. Likewise a lower value can be provided for the standard range, which undershoots the nominal inflow by a specific percentage value, for example 10%.

The washing liquor S that has reached the washing compartment 7 via the fluid inlet 19, because of its gravitational force, arrives in a collection device 21, which can preferably be embodied as a reservoir 21, embodied on a floor 20 of the washing container 5. An input side of a recirculation pump 22 is connected in this case to the reservoir 21 for conducting fluid. Furthermore an output side of the recirculation pump 22 is connected to a spray device 23, 24, which makes it possible to apply washing liquor S to the items to be washed inserted into the washing compartment 7. In the exemplary embodiment of FIG. 1 the spray device 23, 24 comprises an upper rotatable spray arm 23 and a lower rotatable spray arm 24. However fixed spray elements could be provided as an alternative or in addition.

The washing liquor S exiting from the spray device 23, 24 with the recirculation pump 22 switched on, as a result of its gravitational force within the washing compartment 7, arrives back in the reservoir 21. During the recirculation of the washing liquor S in the washing compartment 7 the aim is to operate the recirculation pump 22 in true running mode. The recirculation pump 22 is in true running mode if an amount of washing liquor S is available which is large enough for the pump to exclusively convey washing liquor S or, conversely, not to convey any air. The operation of the recirculation pump 22 in true running mode on the one hand allows sufficient pump pressure to be achieved for an intended cleaning effect and on the other hand enables the generation of irritating slurping noises to be avoided. In order to now determine whether the recirculation pump 22 is in true running mode or not, a true running monitoring unit 25 is provided. This can be provided as a separate component or, if necessary, as a component of the control device 2 instead.

The dishwasher 1 also features a conventional dispensing device 26 which introduces the washing liquor S introduced into the washing compartment 7, with cleaning agents and/or cleaning aids, to improve the cleaning effect and/or the drying effect of a wash cycle.

The dishwasher 1 shown in FIG. 1 also features a drain device 27 that is used to pump washing liquor that is no longer needed out of the washing compartment 7 as waste water AW. The drain device 27 comprises a drain pump 28 having an input side connected to the reservoir 21. The output side of the drain pipe 28, on the other hand, is connected to a connection line 29 that has its downstream end connected to a connection 30 of the dishwasher 1 affixed to the housing. Attached to an outlet of the connection 30 fixed to the housing is a drain hose 31 which, in the embodiment shown in FIG. 1, is a flexible hose. At the downstream end of the drain hose 31 is a connecting piece 32 that is designed to connect the drain device 27 to a wastewater disposal device AR. The waste water disposal device AR can be a drain pipe or a building-side water installation. The connection between the connecting piece 32 and the drain pipe can be a screw connection, a bayonet connection, a plug-in connection or some other similar connection.

Figure 2:
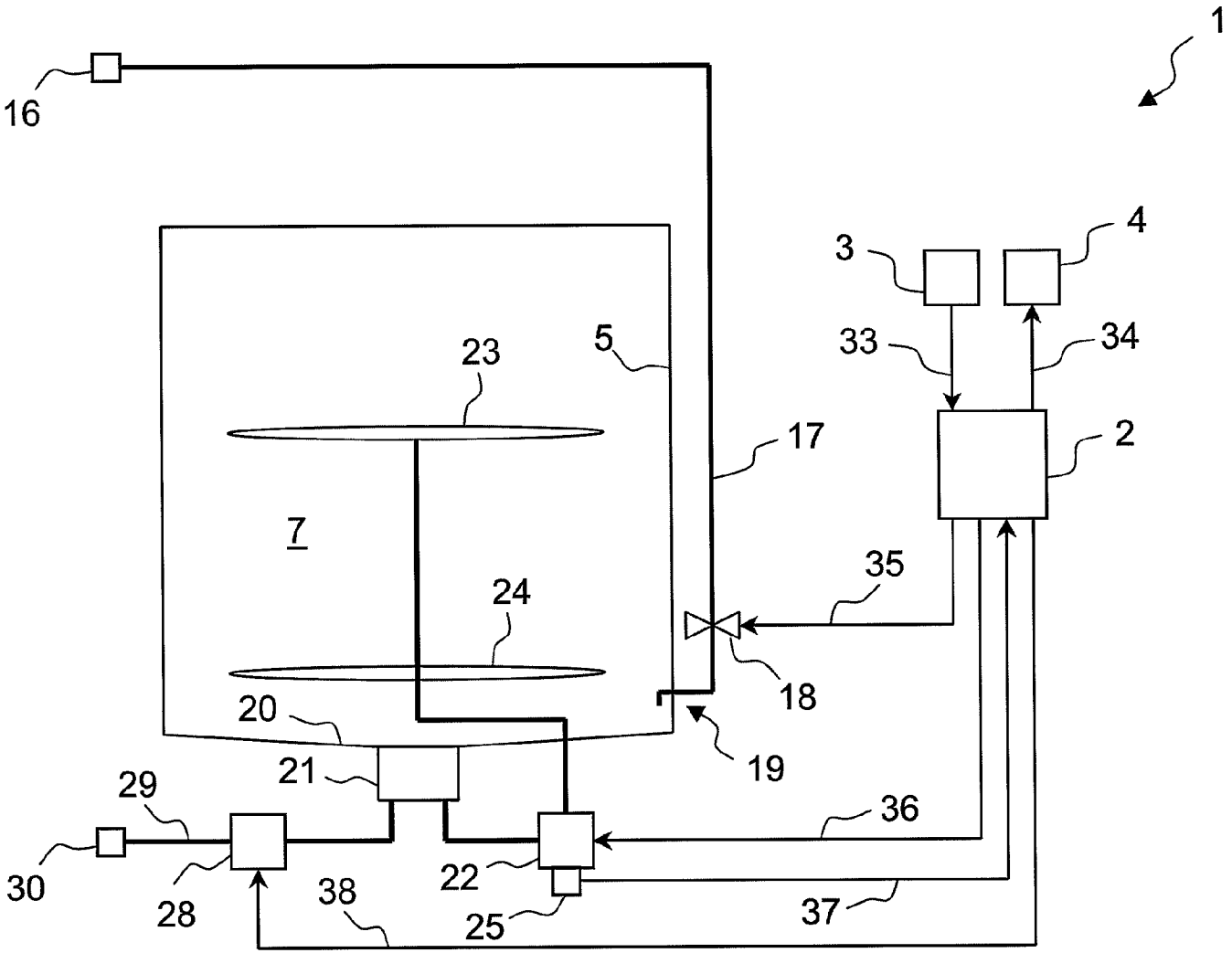
FIG. 2 is a schematic block diagram of the dishwasher of FIG. 1.

FIG. 2 is a block diagram of the household dishwasher 1 of FIG. 1 that shows its control and communication design. In FIG. 2 a signal line 33 connects the operating device 3 to the control device 2 so that operating commands provided by a user are transmitted from the operating device 3 to the control device 2. Furthermore a signal line 34 is provided that connects the control device 2 to the output device 4, so that information provided by the control device 2 can be transmitted to the output device 4 for output by the output device 4 to the user.

Furthermore a control line 35 is provided, which connects the control device 2 to the switchable inlet valve 18 such that the inlet valve 18 can be closed or opened respectively by the control device 2. In this way the filling of the washing compartment 7 with washing liquor S can be controlled by the control device 2. A further control line 36 connects the control device 2 to the recirculation pump 22. This enables the recirculation pump 22, especially its speed, to be adjusted, especially controlled or regulated, by the control device 2.

Furthermore a signal line 37 is provided which connects the true running monitoring unit 25 to the control device 2. The signal line 37 makes it possible to transmit to the control device 2 information generated by the true running monitoring unit 25 relating to the running characteristics of the recirculation pump 22. In this case the control device 2 is embodied so that, when it switches, especially controls the closing and/or opening times, if necessary also controls or regulates the inlet valve 18, this information can be taken into account by the true running monitoring unit 25. Furthermore a control line 38 is provided which connects the control device 2 to the drain pump 28 so that the drain pump 28 is also able to be switched, especially switched off and switched on, by the control device 2.

Figure 3:
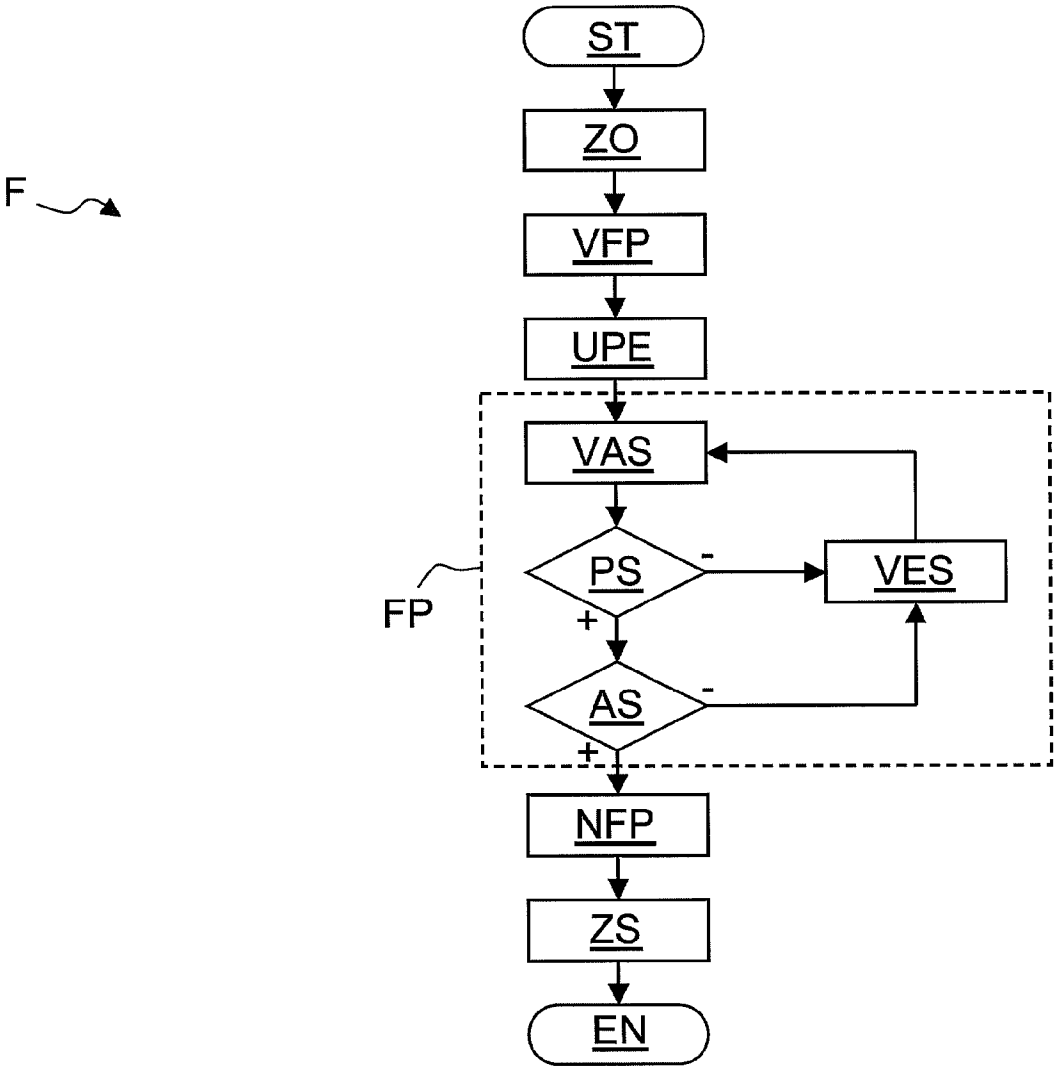
FIG. 3 is a flow diagram of a fill sequence for the dishwasher of FIGS. 1 and 2.

FIG. 3 shows a flow diagram of a fill sequence F for the inventive household dishwasher 1 of the exemplary embodiment. The fill sequence F preferably represents a self-contained aspect of the invention. It can be executable or controllable by the control device 2 and can be carried out once or a number of times during the execution of a washing cycle. After a start ST of the fill sequence F the inlet valve 18 is opened in a step ZO. A pre-fill phase VFP begins with the opening of the inlet valve 18, with the duration of said phase depending on a default time value which can typically be contained in a washing program called up by the user. The default time value in this case can be defined such that during the pre-fill phase VFP, under normal conditions such an amount of washing liquor S gets into the washing compartment 7 as is sufficient for true running of the recirculation pump 22, running at a speed which amounts to 40% to 60% of its final speed for example. At the end of the pre-fill phase VFP the recirculation pump 22 is then switched into a step UPE and operated with a start value for its speed.

With the switching on of the recirculation pump 22 a fill phase FP is initiated in which an algorithm or sequence of steps respectively is executed to vary the speed of the recirculation pump 22.

This algorithm comprises a variation step VAS for graduated variation of the speed by a default value, a test step PS for carrying out a true running check, an abort step AS for aborting the fill phase FP and a modification step VES for modifying the default value for a renewed execution of the variation step BAS as a function of a result of the test step PS. In the exemplary embodiment the variation step VAS is initially carried out in which the speed of the recirculation pump is modified around a start value of a default value.

The variation step VAS is followed by the test step PS in which a check is made by means of the true running monitoring unit 25 as to whether the recirculation pump 22 is running true or not.

Provided the recirculation pump 22 is running true, the abort step AS is carried out in which the predetermined abort conditions are checked for their occurrence. Otherwise the modification step VES is carried out, in which the default value is adapted for a renewed execution of the variation step VAS. In this case a check can be made as an abort condition as to whether the speed of the recirculation pump 22 has reached a final value. If it has, it can be concluded that the washing compartment 7 has been filled with an amount of washing liquor S such that in principle true running operation of the recirculation pump is possible during the continuation of the washing cycle. If the abort conditions do not apply on the other hand, the modifications step VES is carried out in which the default value for a new execution of the variation step VAS is adapted.

During the modification step VES the default value is adapted as a function of the preceding test step PS. If true running of the recirculation pump 22 is established in this step, the default value is typically increased, in which case the slope of a curve representing the speed is increased in the next variation step VAS, so that the speed from below approximates to the value at which true running is still just possible with the current amount of washing liquor S. A maximum value can be provided in this case for the default value, which when reached suppresses any intended increase.

If it is established on the other hand that the circulation pump 22 is not running true, the default value is typically lowered, whereby the slope of the curve representing the speed is also lowered in the next variation step VAS, so that the speed from above approximates to the value at which true running is still just possible for the current amount of washing liquor S. In this case a minimum value can be provided for the default value at which, when it is reached, an inherently provided reduction is suppressed.

When the fill phase FP is ended on establishing the occurrence of the abort conditions in the abort step AS, it is followed by a time-controlled post-fill phase NFP, the duration of which depends on a further default time value which can for example be contained in the wash program called up by the user. The default time value in this case can be defined so that during the post-fill phase NFP under normal conditions, such an amount of washing liquor S arrives in the washing compartment 7 as a reserve as amounts to for example 10% to 20% of the amount of the pre-fill phase VFP. The provision of reserves of washing liquor by means of the post-fill phase NFP is not absolutely necessary but is sensible in many cases. At the end of the post-fill phase NFP the inlet valve 18 is then closed in a step ZS and the end EN of the fill sequence F is reached.

The fill sequence F illustrated with reference to FIG. 3 ensures that at its end EN the recirculation pump 22 can be operated in true running mode at its final speed. The fill sequence F also allows washing liquor S to be used sparingly. In this case neither a complex measurement of the amount of washing liquor S supplied or the fill level of the washing liquor S in the washing compartment 7 nor control of the inflow of the washing liquor S is necessary. Compared to a conventional dishwasher in which the amount of the supplied washing liquor S is controlled exclusively by the time, in respect of the mechanical design of the inventive dishwasher 1 only the true running monitoring unit 25 as well as an adaptation of the control device 2 is necessary. Likewise the described fill sequence F ensures that the cleaning effect of a wash cycle starts even during the fill sequence F. Slurping noises of the recirculation pump 22 are minimized in this case since this can be operated in true running mode for a largely predominant part of the duration of the fill sequence F.

Figure 4:
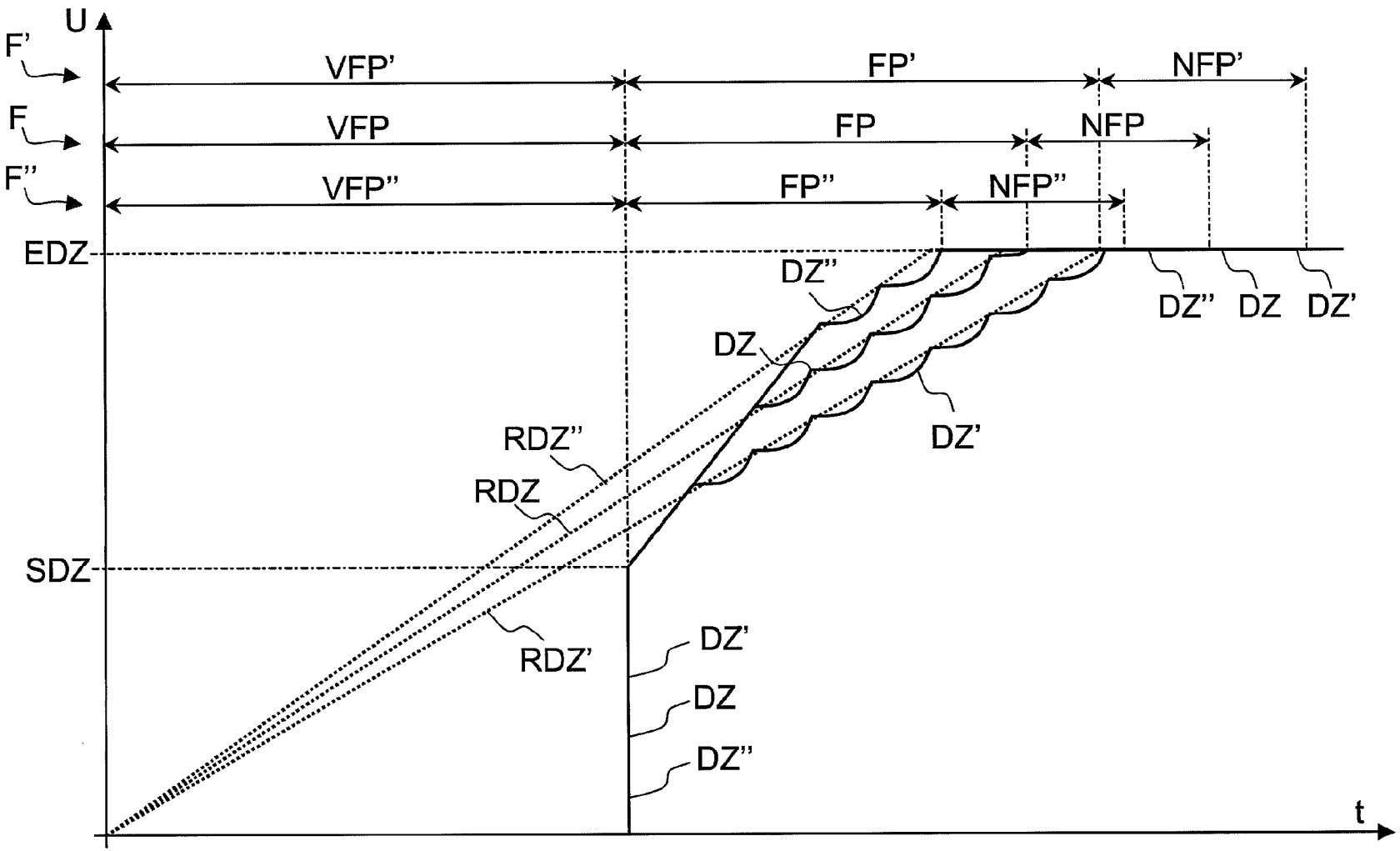
FIG. 4 is a diagram of fill sequences for the dishwasher of FIGS. 1 and 2.

FIG. 4 shows a diagram of fill sequences F, F', F" of an inventive dishwasher 1 in which the speed of the recirculation pump 22 is plotted on the vertical axis U and the time is plotted on the horizontal axis t. The fill sequence F comprises a pre-fill phase VFP, a fill phase FP and a post-fill phase NFP. Furthermore the fill sequence F' comprises a pre-fill phase VFP', a fill phase FP' and a post-fill phase NFP'. Likewise the fill sequence F" comprises a pre-fill phase VFP", a fill phase FP" and a post-fill phase NFP".

In this case the curve DZ shows the speed DZ of the recirculation pump 22 during the fill sequence F with the assumption that there is an inflow with the inlet valve 18 opened which corresponds to the nominal inflow. A curve RDZ shows that maximum true running speed RDZ at which in this case true running of the recirculation pump 22 is still just possible. Furthermore a curve DZ' shows the speed DZ' of the recirculation pump 22 during the fill sequence F', in which case it is assumed that there is an inflow with the inlet valve 18 opened which corresponds to the minimum inflow of the normal range. In this case a curve RDZ' shows the associated maximum true running speed RDZ' here. Likewise a curve DZ" shows the speed DZ" of the recirculation pump 22 during the fill sequence F", in which case it is assumed that there is an inflow with the inlet valve 18 opened which corresponds to the maximum inflow of the normal range. A curve RDZ" shows the corresponding maximum true running speed RDZ".

The fill sequence F will be explained first. At the beginning of the fill sequence F the inlet valve 18 is open so that washing liquor S starts to fill the washing compartment 7. This causes the maximum true running speed RDZ to increase starting from zero, over the course of time. At the beginning of the fill phase F the recirculation pump 22 is switched on and is initially operated at a speed DZ which corresponds to a start value SDZ. This speed SDZ lies outside the maximum true running speed RDZ so that within the framework of the algorithm explained with reference to FIG. 3, the speed DZ is increased with a maximum provided default value i.e. with a maximum slope until such time as a non-true running of the recirculation pump is detected for the first time. Now the default value is reduced, i.e. the slope of the speed DZ is reduced, until such time as true running occurs again. Subsequently the default value is increased until non-true running is detected again. In this way it is ensured that the speed DZ essentially lies just below the maximum true running speed RDZ. The fill phase FP is aborted if the speed DZ reaches an end value EDZ and the recirculation pump 22 is in true running mode in this case. In this way it is ensured that at the end of the fill phase SP there is an amount of washing liquor S in the washing compartment 7 which principally makes it possible for the recirculation pump 22 to be able to be operated in true running mode at its final speed EDZ. The time-controlled post-fill phase NFP which now follows ensures that an additional amount of washing liquor S reaches the washing compartment so that true running occurs even if washing liquor is removed from the recirculation circuit, for example by washing liquor S collecting in an upturned hollow vessel to be cleaned.

The fill sequences F' and F" execute in a similar manner. However the maximum true running speed RDZ' exhibits a smaller slope and the maximum true running speed RDZ" a greater slope than the maximum true running speed RDZ. In this case, based on the algorithm described the speed DZ' follows the maximum true running speed RDZ' and the speed DZ" the maximum true running speed RDZ". In both cases it is ensured that the recirculation pump 22 is essentially operated in true running mode. It is likewise ensured in both cases that at the end of the fill phases F', F", the washing compartment 7 has been filled with an optimized amount of washing liquor S.

Figure 5:
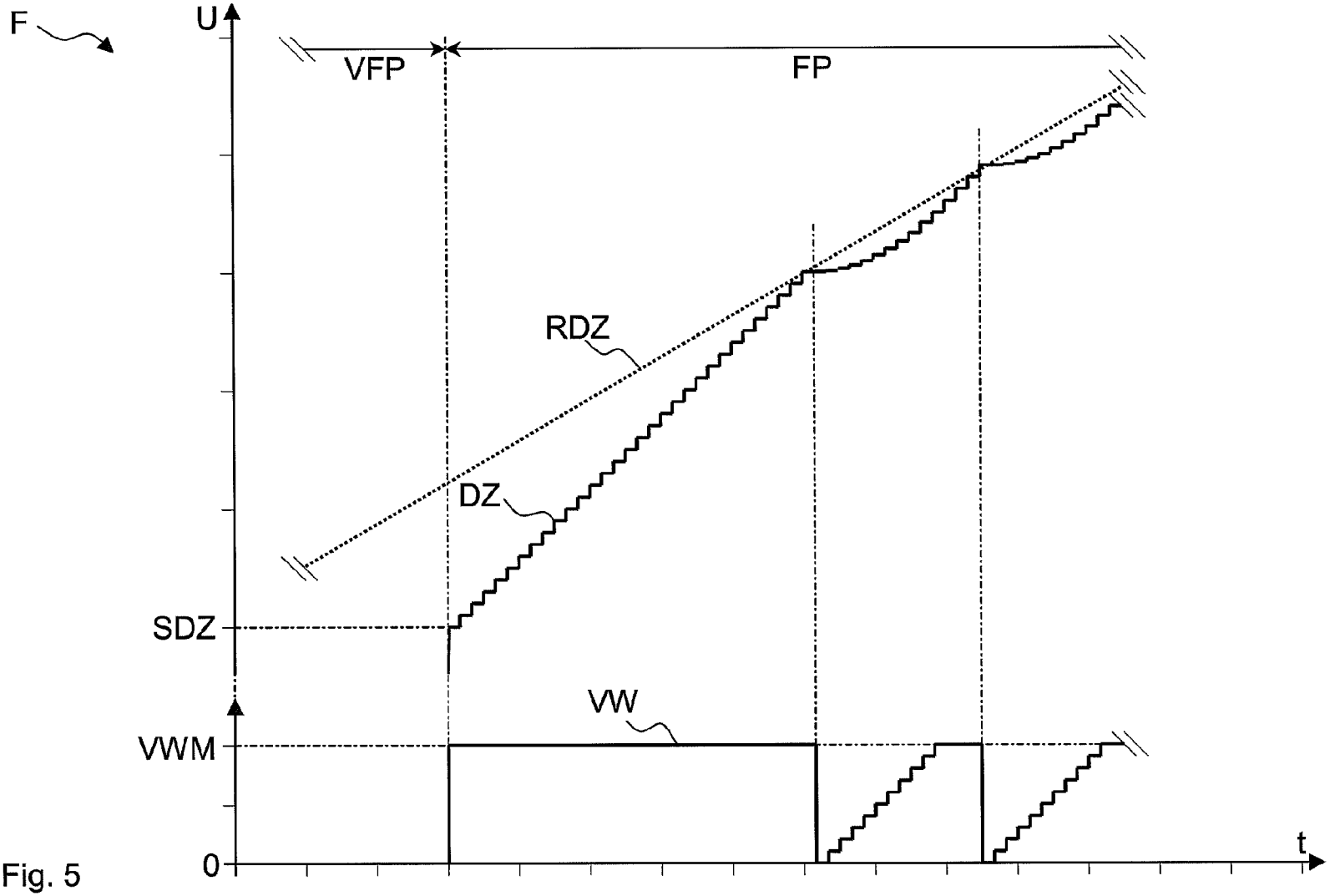
FIG. 5 is a further diagram of a fill sequence for the dishwasher of FIGS. 1 and 2.

FIG. 5 shows an enlarged section of the fill sequence F of FIG. 4, with the default value VW additionally being shown in the time curve. It can be seen in this figure that the speed DZ is adapted in steps in the time curve.

At the beginning of the fill phase SP the default value VW is set so that it corresponds to a predetermined maximum value VWM. The maximum value VWM is selected so that the average slope of the speed DZ is initially greater than the slope of the maximum true running speed RDZ. This means that the speed DZ first approaches the maximum true running speed RDZ and exceeds it, which is detected in a test step PS. The default value VW is now set to zero, so that the speed DZ remains unchanged for an execution of the algorithm. Since the maximum true running speed RDZ continues to increase during this time, in the example of FIG. 5 the recirculation pump 22 immediately gets back into the true running mode. Thus the default value VW is increased again.

If the recirculation pump 22 were not to get back immediately into true running mode, for example because there is a fault in the water supply WH, the default value VW would be temporarily further reduced and thus assume negative values.

In the example of FIG. 5 the default value VW is increased up to the maximum value VWM, since in this time window true running is always present, so that the average slope of the speed DZ also increases up to its maximum value.

If on the other hand non-true running were to occur beforehand, the default value is VW would be set to zero before it reaches its maximum value VWM.

In the example of FIG. 5 the default value VW now remains at its maximum value VWM until there is renewed non-true running. This method repeats until such time as the final value EDZ of the speed of the recirculation pump 22 is reached and the post-fill phase NFP is executed.

In an advantageous exemplary embodiment of the invention a sufficient fill amount is established by a dynamic speed increase with true running detection. A sufficient fill amount can be recognized by the fact that the recirculation pump continues to approach the limit of true running. As is demonstrated in the figures, this can occur in the following way: After the compartment has been filled with a specific minimum amount of water the pump is started and its speed is continuously increased. In this case the pump power or the pump flow is recorded. If a distribution or a deviation of the parameters is detected for the pump power or the pump flow, the true running amount for the amount of water which has flowed in thus far is reached and the increase in the pump speed is reduced until the distribution of the pump power or of the pump flow reduces again. This should be executed such that the increase in the pump speed is adapted to the inflowing amount of water.

On the basis of this method the sufficient fill amount can then be determined by means of the pump speed and the fill process can be ended on reaching a predetermined speed.

In order to ensure a secure true running thereafter an additional amount of water can be provided by means of a fixed post-fill time.

This method makes it possible to rapidly detect the fill level in the household appliance, especially the dishwasher, preferably household dishwasher, which reduces errors with the fill amount. In addition the pump mainly runs in true running mode during the filling, whereby the pump noise is reduced compared to non-true running mode. A further advantage is the variable fill the amount when dishes have been incorrectly positioned (e.g. bowl or pot). If the current washing amount has an insufficient amount of water, this amount is compensated for by the true running algorithm and the compartment is refilled with sufficient water for true running to be guaranteed.

What is claimed is:

1. A dishwasher having a washing cycle, the dishwasher comprising:

a washing compartment for accommodating items to be washed by the washing cycle, said washing compartment having an inlet valve;

a control device to carry out the washing cycle to clean the items to be washed;

a recirculation pump to recirculate washing liquor present in the washing compartment;

an electric motor to drive the recirculation pump; and a true running monitoring unit configured to execute a true running test to monitor at least one electrical operating parameter of the electric motor to determine whether or not the recirculation pump is running in true mode, the true running monitoring unit being configured to generate an output indicating whether or not the recirculation pump is running in true mode based on a result of the true running test and being configured to communicate the output to the control device, wherein the recirculation pump is running in the true mode when there is sufficient washing liquor in the washing compartment to prevent air from being sucked in by the recirculation pump, and the control device is configured to:

open the inlet valve to fill the washing compartment with washing liquor;

activate the recirculation pump during a fill phase of the washing cycle;

execute an algorithm which increments the speed of the recirculation pump by a value in accordance with the output of the true running monitoring unit until a predetermined final speed of the recirculation pump is reached, the value being set to a predetermined initial positive value and the value being set to less then or equal to zero when the true running monitoring unit indicates that the recirculation pump is not running in the true mode and the value being incrementally increased each time the true running monitoring unit indicates that the recirculation pump is running in the true mode until the predetermined initial positive value is reached; and close the inlet valve when the predetermined final speed is reached.

2. The dishwasher of claim 1, wherein the dishwasher is a household dishwasher.

3. The dishwasher of claim 1, further comprising a decrementing step in the algorithm, said decrementing step decreasing the value when consecutive iterations of the true running test indicate that the recirculation pump is not running true.

4. The dishwasher of claim 3, wherein the value is not decreased if the value is equal to a given minimum value.

5. The dishwasher of claim l, further comprising a zeroing step in the algorithm, said zeroing step setting the value to zero when consecutive iterations of the true running test indicate that the recirculation pump is either running true in one iteration of the true running test and not running true in the next iteration, or not running true in one iteration of the true running test and running true in the next iteration.

6. The dishwasher of claim 1, further comprising a pre-fill time value for a pre-fill phase of the washing cycle, said pre-fill phase being carried out before the fill phase, said inlet being open and said recirculation pump being switched off during the pre-fill phase, the duration of the pre-fill phase depending on said pre-fill time value.

7. The dishwasher of claim 1, further comprising a start value for the speed the recirculation pump, said start value providing a recirculation pump speed such that, for an inflow of washing liquor lying within a normal range, the first iteration of the algorithm will indicate that the recirculation pump is running true.

8. The dishwasher of claim 1, further comprising a post-fill time value for a post-fill phase of the washing cycle, said post-fill phase being carried out after the fill phase, said inlet being open and said recirculation pump being switched on during the post-fill phase, the duration of the post-fill phase depending on said post-fill time value.

9. The dishwasher of claim 1, wherein said true running monitoring unit is adapted to monitor fluctuations in the electric motor.

10. A method for operating a dishwasher having a control device for carrying out a washing cycle for cleaning items to be washed in a washing compartment that accommodates items to be washed during the washing cycle, an inlet valve adapted to be opened by a control device controlling the washing cycle to fill the washing compartment with washing liquor during a fill phase of the washing cycle, a recirculation pump for recirculating washing liquor present in the washing cycle, an electric motor to drive the recirculation pump, the control device controlling the recirculation pump, and a true running monitoring unit adapted for carrying out a true running test to check the recirculation pump, said method comprising the steps of:

carrying out at least one fill phase during the wash cycle, the inlet valve being open and the recirculation pump being switched on during the fill phase;

executing an algorithm which varies the speed of the recirculation pump, the algorithm including a test step for executing a true running test with a true monitoring unit to monitor at least one electrical operating parameter of the electric motor to determine whether or not the recirculation pump is running in true mode, the true monitoring unit being configured to generate an output indicating whether or not the recirculation pump is running in true mode based on a result of the true running test;

wherein the recirculation pump is running in the true mode when there is sufficient washing liquor in the washing compartment to prevent air from being sucked in by the recirculation pump, and wherein the algorithm increments the speed of the recirculation pump by a value in accordance with the output of the true running monitoring unit until a predetermined final speed of the recirculation pump is reached, the value being set to a predetermined initial positive value and the value being set to less then or equal to zero when the recirculation pump is not running in the true mode and the value being incrementally increased each the true running monitoring unit indicates that the recirculation pump is running in the true mode until the predetermined initial positive value is reached; and closing the inlet valve when the predetermined final speed is reached.

11. The method of claim 10, wherein the algorithm further comprises a decrementing step decreasing the value when consecutive iterations of the test step indicate that the recirculation pump is not running true.

12. The method of claim 11, wherein the value is not decreased if the value is equal to a given minimum value.

13. The method of claim 10, wherein the algorithm further comprises a zeroing step setting the value to zero when consecutive iterations of the test step indicate that the recirculation pump is either running true in one test step and not running true in the next test step, or not running true in one test step and running true in the next test step.

14. The method of claim 10, further comprising the step of carrying out a pre-fill phase of the washing cycle, said pre-fill phase being carried out before the fill phase, said inlet being open and said recirculation pump being switched off during the pre-fill phase, the duration of the pre-fill phase depending on a pre-fill time value.

15. The method of claim 10, further comprising a start value for the speed of the recirculation pump such that, for an inflow of washing liquor lying within a normal range, the first iteration of the algorihtm will indicate that the recirculation pump is running true.

16. The method of claim 10, further comprising the step of carrying out a post-fill phase of the washing cycle, said post-fill phase being carried out after the fill phase, said recirculation pump being switched on during the post-fill phase, the duration of the post-fill phase depending on a post-fill time value.

17. The method of claim 10, wherein the true running monitoring unit is adapted to monitor fluctuations the electric motor.

* * * * *